United States Patent [19]

Miyazawa et al.

[11] Patent Number: 4,648,346

[45] Date of Patent: Mar. 10, 1987

[54] PALLET FOR USE IN PRODUCTION OF COLOR CATHODE RAY TUBE

[75] Inventors: Hideo Miyazawa; Shokichi Endo, both of Mobara; Hideo Nishimoto, Yachiyo, all of Japan

[73] Assignee: Hitachi, Ltd., Tokyo, Japan

[21] Appl. No.: 845,617

[22] Filed: Mar. 28, 1986

Related U.S. Application Data

[63] Continuation of Ser. No. 555,614, Nov. 28, 1983, abandoned.

[30] Foreign Application Priority Data

Nov. 26, 1982 [JP] Japan ..... 57-206184

[51] Int. Cl.[4] ..... B05C 13/02

[52] U.S. Cl. ..... 118/500; 250/491.1; 445/68

[58] Field of Search ..... 445/68, 60, 65, 30; 250/491.1; 354/1; 269/908; 198/345; 118/500; 430/23

[56] References Cited

U.S. PATENT DOCUMENTS

| | | | |
|---|---|---|---|
| 3,949,226 | 4/1976 | Dugan et al. | 354/1 X |
| 4,130,919 | 12/1978 | Oyama | 445/68 |
| 4,331,228 | 5/1982 | Galarowic | 198/345 X |
| 4,431,103 | 2/1984 | Sekei | 198/345 |
| 4,451,242 | 5/1984 | Miyazawa et al. | 445/68 X |

*Primary Examiner*—John P. McIntosh

*Attorney, Agent, or Firm*—Antonelli, Terry & Wands

[57] ABSTRACT

An exposure apparatus for pallet carrying a panel of a color CRT and a shadow mask, with the pallet 9 is used conveniently in attaching and detaching the shadow mask to and from the panel and in conveying the panel 4 and the shadow mask 8 in both of combined and separated configurations along a floor conveyor. The pallet has upper and lower reference plates for precisely locating the pallet vertically and horizontally with respect to the exposure apparatus.

2 Claims, 8 Drawing Figures

PALLET FOR USE IN PRODUCTION OF COLOR CATHODE RAY TUBE

This is a continuation of application Ser. No. 555,614, filed Nov. 28, 1983 now abandoned.

BACKGROUND OF THE INVENTION

The present invention relates to a pallet suitable for use in automating an exposure step in the panel coating process for a production of a color cathode ray tube hereinafter referred to as a "CRT".

Generally, the process for producing a color CRT has an exposure step in which a panel is exposed for a number of times together with a shadow mask in order to deposit a light-absorbing substance on the inner surface of the panel and to form fluorescent dots and stripes having three types of luminescent colors including red, green and blue.

In recent years, such an automatic color CRT production line has been proposed which employs an automatic apparatus for attaching and detaching the shadow masks and an automatic production using a floor conveyor; however, the supply of workpieces to the exposure apparatus still relies upon an overhead type vacuum transfer device.

However, in view of the current tendency toward automated production process employing a floor conveyor, the use of the overhead type vacuum transfer device characteristically different from the floor conveyor is not convenient from the point of view of both a reduction of installation space and a reduction of overall cost.

SUMMARY OF THE INVENTION

Accordingly, an object of the invention is to provide a novel pallet which permits a direct connection between the conveyor line and the exposure apparatus through a floor conveyor to thereby simplify the automatic system for the production of color CRT.

To this end, according to the invention, a pallet is provided which functions as a top plate necessary for the exposure and a transfer means for transferring the workpiece.

Other and further objects, features and advantages of the invention will become more apparent from the following description when taken in connection with the accompanying drawings.

DETAILED DESCRIPTION

Figure 1:
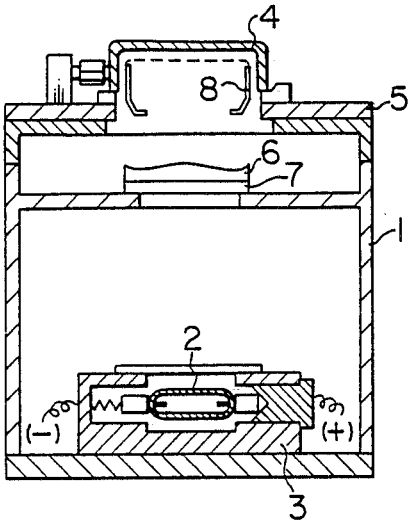
FIG. 1 PRIOR ART
FIG. 1 is a vertical cross-sectional view of a portion of a conventional exposure apparatus.

Referring now to the drawings wherein like reference numerals are used throughout the various views to designate like parts and, more particularly, to FIG. 1, according to this figure, a housing 1 of an exposure apparatus has disposed therein a lamp house 3 accommodating an exposure light source 2 which is, for example, usually constructed as a high-pressure mercury lamp. A top plate 5 is provided for locating and carrying a panel 4, with the top plate 5 being disposed along an upper wall of the housing 1. A compensating lens 6 and a filter 7 are disposed in the path of light between the exposure light source 2 and the panel 4, with a shadow mask 8 being mounted at an inner side of the panel 4.

In the conventional exposure apparatus of FIG. 1, a workpiece or work unit having a panel 4 and a shadow mask 8, fitted in the panel, are supplied by an overhead type vacuum transfer device onto the top plate 5 and, after an exposure the panel unit is transferred to the next step by the same transfer device.

Figure 2:
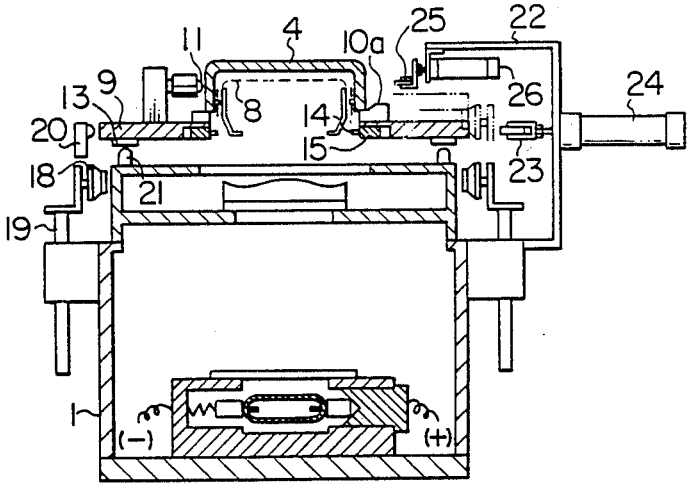
FIG. 2 is a vertical cross-sectional view of an exposure apparatus employing a pallet constructed in accordance with the present invention.
Figure 3:
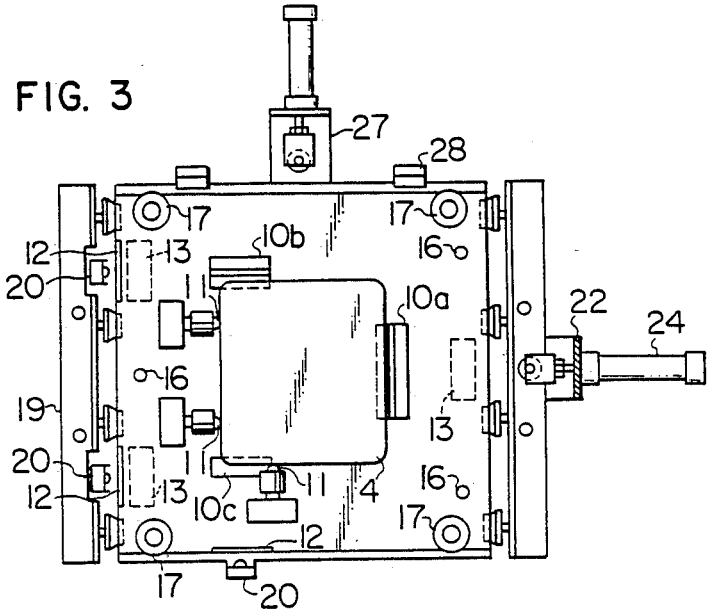
FIG. 3 is a plan view of the apparatus shown in FIG. 2.

As shown in FIGS. 2 and 3, in accordance with the present invention, a pallet 9 includes three panel supports 10*a*, 10*b* and 10*c* for supporting the panel 4, three reference nylon balls 11 for precisely locating the panel 4 on the pallet 9, three side reference plates 12 for locating the pallet 9 in the horizontal plane parallel to the exposure apparatus, three lower reference plates 13 for locating the pallet 9 in a vertical direction with respect to the exposure apparatus, a mask-receiving framework 15 having dummy pins 14 for receiving the shadow mask 8, three reference holes 16 adapted to engage a shadow mask attaching/detaching apparatus during attaching and detaching of the shadow mask, and rollers 17 for enabling the pallet 9 to smoothly run on a conveyor. The exposure apparatus includes a transfer roller unit 18 secured to the housing 1 and adapted for transfer the pallet 9 into and out of the exposure apparatus. The transfer roller unit 18 is movable up and down by means of a lifting mechanism 19 which is operated by a pneumatic cylinder, not shown. The positioning of the pallet 9 is carried out by employing stationary reference points 20 fixed to the portions of the housing 1 corresponding to the side reference plates 12 and pallet supports 21 which are fixed to the portions of the upper wall of the housing corresponding to the lower reference plates 13.

As shown most clearly in FIG. 2, a bracket 22 is disposed at a side of the pallet 9 opposite to the stationary reference point 20, with the bracket 22 being provided at an portion thereof disposed in opposition to the reference point 20, with a pneumatic pusher 24 having a pad 23. The arrangement is such that, as the pneumatic pusher 24 pushes the pallet 9, the pallet is brought into contact with the reference points 20 so as to be horizontally located by the latter. Similarly, a pneumatic pusher 26 having an end pad 25, disposed at a position opposite to the nylon ball 11, is adapted to push the panel 4 into contact with the nylon balls to thereby to horizontally locate the panel 4. The positioning of the pallet and the panel in another horizontal direction, orthogonal to the above-mentioned direction, is effected substantially in the same manner as that described above, by means of a similar bracket 27 shown in FIG. 3 and other associated members. A pallet stopper 28 is provided to stop the pallet 9 when the latter has brought to the designated position on the exposure apparatus.

Figure 4:
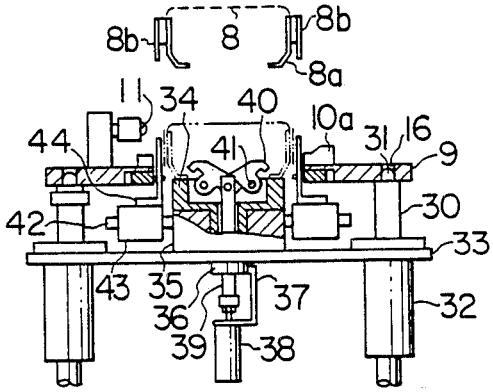
FIG. 4 is a cross-sectional view of a portion of a shadow mask attaching apparatus employing a pallet constructed in accordance with the present invention.

As shown in FIG. 4, the pallet is adapted to receive the shadow mask 8, with the shadow mask attaching apparatus including three positioning pillars 30 corresponding to three holes 16 formed in the pallet 9. The pillars 30 are provided at their ends with tapered pins 31 adapted to engage with the reference holes 16 in the pallet thereby to locate the pallet 9. The pillars 30 are constructed integrally with guide sleeves 32 and a lifting table 33 so as to be moved up and down as a unit by, for example, a pneumatic cylinder. A pedestal 34, holding the frame position 8*a* of the shadow mask 8, is mounted on the center of the lifting table 33 through a base 35. The pedestal 34 includes a clamping mechanism adapted to clamp the frame 8*a* of the shadow mask 8. More specifically, the pedestal 34 has a cylindrical portion 36 which projects to the lower side of the lifting table 33 and mounts a bracket 37. A pneumatic cylinder 38 for performing a clamping action is mounted on the bracket 37 so that a connecting rod 39 is moved up and down by the operation of the pneumatic cylinder 38. At the same time, clamping claws 40 are swung in opposite directions around fulcrums constituted by pins 41 to thereby press upper surface of the lower end flanges of the shadow mask frame 8 so that the shadow mask 8 is fixed. Furthermore, the base 35 carries a horizontal guide shaft 42 along which a slide block 43 is slidable by the operation of a pneumatic cylinder, not shown. The slide block 43 has retaining claws 44 for compressing the springs 8*b* on the shadow mask 8.

Figure 5:
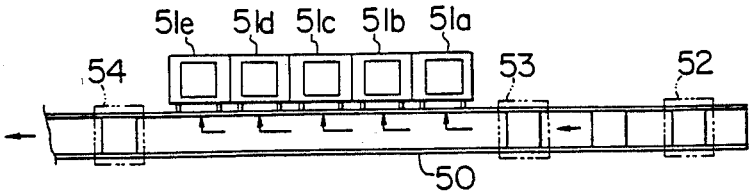
FIG. 5 is a side view of a conveyor line apparatus for conveying pallets constructed in accordance with the present invention.

Referring to FIG. 5, in a production line, a conveyor line 50 runs along exposure apparatus 51*a*, 51*b*, 51*c*, 51*d* and 51*e*. A shadow mask attaching apparatus of the type shown in FIG. 4 is arranged at a first station 52, while a shadow mask detaching apparatus for mounting the shadow mask 8 on the panel, having a construction similar to the shadow mask attaching apparatus, is arranged at a second station 53. A third station 54 has a mask detaching apparatus which is adapted to detach the shadow mask 8 from the panel 4 after the exposure.

Figure 6:
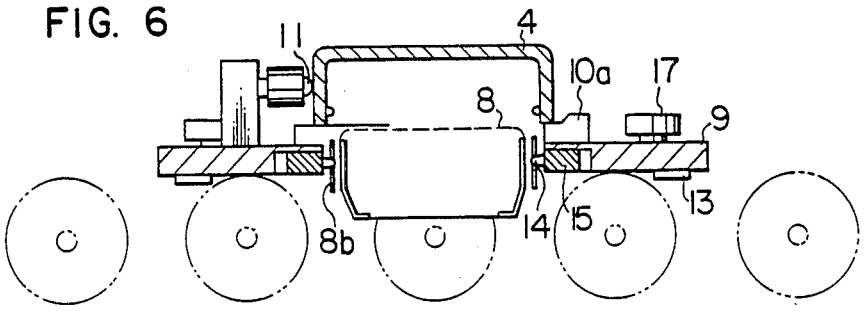
FIG. 6 is a cross-sectional view of a portion of a pallet constructed in accordance with the present invention.
Figure 7:
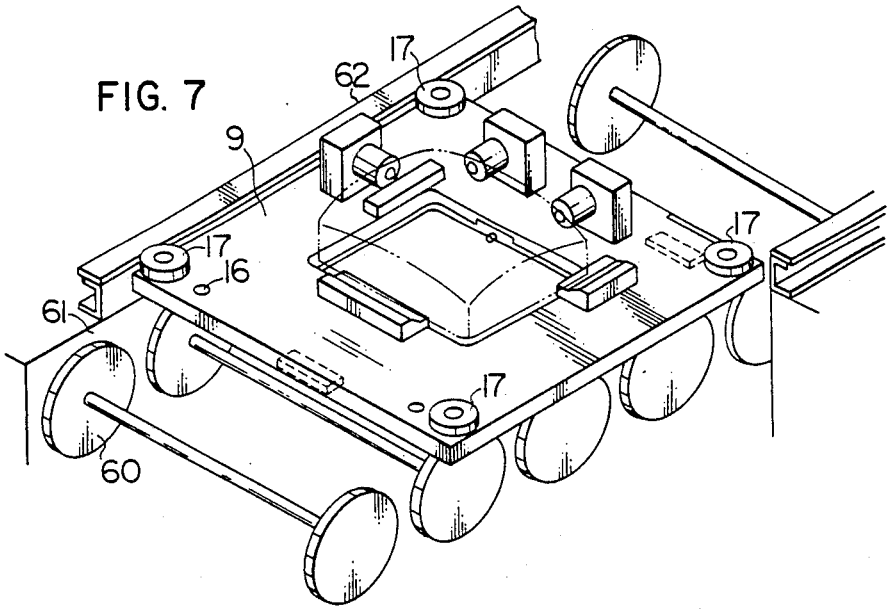
FIG. 7 is a perspective view of a pallet constructed in accordance with the present invention mounted on the conveyor.
Figure 8:
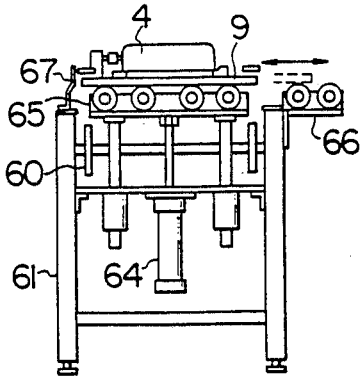
FIG. 8 is a front elevational view of a transverse conveyor carrying pallets constructed in accordance with the present invention.

In operation, a shadow mask 8 and a panel 4 are supplied to the pallet 9 at the first station. Referring again to FIG. 4, after stopping a vacant pallet at the first station 52 in the conveyor line 50, the pillars 30 are projected upwardly to insert the tapered pins 31 into the holes 16 in the pallet 9 to thereby locate the latter. At the same time, the lifting table 33 is lifted to a predetermined position. In this state, the clamping claws 40 and the retaining claws 44 are held in the open state to permit the shadow mask 8 to be placed on the pedestal 34. Subsequently, the pneumatic cylinder 38 operates to project the rod thereof to thereby lift the connecting rod 39. Consequently, the clamping claws 40 are swung to press the bottom surface of the frame 8*a* onto the pedestal 34 and, thereafter, the slide block 43 is shifted towards the pedestal to make the retainer claws 44 press the springs 8*b* of the shadow mask 8 towards the frame 8*a*. In this state, the lifting table 33 is lowered until the positions of the holes of the springs 8*b* comes into heightwise alignment with the dummy pins 14 in the pallet 9. At such a position, the lifting table 33 is stopped and the retaining claws 44 are released to allow the springs 8*b* to move into engagement with the dummy pins 14. Subsequently, the pneumatic cylinder 38 operates to relieve the clamping claws 40 and then the lifting table 33 and the pillars 30 are lowered. As a result, the pallet 9, accomodating the shadow mask 8, is left on the surface of the conveyor 50. Then, a cooperative panel 4 is placed on the panel supports 10*a*, 10*b* and 10*c* of the pallet 9 accomodating the shadow mask 8. The panel in this state is shown in FIG. 6. Then, in the second station 53 shown in FIG. 5, a shadow mask 8 is mounted on the panel 4 by means of a shadow mask mounting apparatus having a construction similar to that explained in connection with FIG. 4. The pallet 9 can be transferred by the conveyor as shown in FIG. 7 in the state after the operation in the first station, i.e. in the state in which the shadow mask 8 is held by the dummy pins 14, as well as in the state after the operation in the second station, i.e. in the state in which the shadow mask is mounted in the panel 4. This example employs a floor conveyor having resin rollers 60 on which the pallets 9 move. In order to ensure a smooth transfer of the pallets 9, guide rails 62 extend along the conveyor frame 61 above both sides thereof so as to cooperate with the rollers 17 on the pallet 9 to guide the pallet. After mounting the shadow mask 8 on the panel 4 at the second station 53, the pallet 9 is brought into the exposure apparatus 51*a* to 51*e* for the exposure, and is then moved out of the exposure apparatus to a next step. In this example, a transverse conveyor as shown in FIG. 8 is used. Namely, after the pallet 9 is conveyed on the transverse conveyor of one of the exposure apparatus, the pneumatic cylinder 64 is operated to extend the rod thereof and transfer the pallet 9 in the direction orthogonal to the conveyor line 50 by means of a transfer unit 65. The transfer of the pallet to the exposure apparatus in transverse direction is assisted by an auxiliary roller unit 66, with a pallet stopper 67 being provided to control a positioning of the pallet 9.

Referring back to FIGS. 2 and 3, the pallet 9, transferred from the conveyor 50, is moved onto the transfer roller unit 18 which has been raised by the lifting mechanism 19. Subsequently, the transfer roller unit 18 is lowered to place the pallet 9 on the pallet supports 21. Then, the pneumatic pushers 24, 25 and other associated parts are operated to precisely locate the pallet 9 and the panel 4 at the exposure position. After the exposure, the transfer roller unit 18 is raised again to move the pallet 9 onto the conveyor 50 which is then conveyed to the third station 54 where the mask detaching apparatus operates so that the shadow mask 8 in the panel 4 is again held by the dummy pins 14 in the pallet 9 as shown in FIG. 6. The pallet in this state is then conveyed to the next step of the production process.

Although the described example employs five exposure apparatus arranged along the conveyor line, it is apparent to those skilled in the art that the number of the exposure apparatus may be changed freely as required by the production process. Moreover, it is also apparent that a production line for production of different types of products can be planned by the combined use of different groups of the exposure apparatus and corresponding types of pallets.

Thus, the invention provides a remarkably effective solution for realizing a simple and efficient automatic production line suitable for the production of color CRTs.

As described hereinabove, the pallet of the invention offers an advantage that the attaching and detaching of the shadow mask, exposure and the transfer of the works throughout the exposure step including the attaching and detaching of the shadow mask can be effected automatically by a through conveyor system without necessitating any transfer machine such as the conventionally used overhead type device characteristically different from the conveyor line.

What is claimed is:

1. An exposure apparatus for exposing a pallet carrying a panel of a color CRT and a shadow mask, the apparatus comprising:

means for locating said panel with respect to said pallet including reference members for defining at least two planes perpendicular to a horizontal plane of said panel;

means for locating said pallet with respect to an exposure apparatus including reference members for defining at least two planes perpendicular to the horizontal plane of the panel and reference members for defining a plane parallel to the horizontal plane of said panel;

means for transferring said pallet through the exposure apparatus; and means for attaching and detaching said shadow mask to and from said panel.

2. An exposure apparatus as set forth in claim 1, wherein said means for transferring said pallet includes a plurality of transfer rollers disposed on a portion of a housing of the exposure apparatus, said transfer rollers being cooperable with the pallet to enable transfer of the pallet through the exposure apparatus.

* * * * *